US008590773B2

(12) United States Patent
Moreau et al.

(10) Patent No.: US 8,590,773 B2
(45) Date of Patent: Nov. 26, 2013

(54) SET OF CARDBOARD BLANKS, BOX AND METHOD FOR MAKING A BOX WITH SUCH BLANKS

(75) Inventors: Jean-Claude Moreau, Saint-Brice (FR); Gérard Mathieu, Cergy (FR); Sébastien Jacomelli, Laives (FR)

(73) Assignee: OTOR, S.A. (FR)

( * ) Notice: Subject to any disclaimer, the term of this patent is extended or adjusted under 35 U.S.C. 154(b) by 465 days.

(21) Appl. No.: 12/936,060

(22) PCT Filed: Mar. 31, 2009

(86) PCT No.: PCT/FR2009/000382
§ 371 (c)(1),
(2), (4) Date: Nov. 2, 2010

(87) PCT Pub. No.: WO2009/133279
PCT Pub. Date: Nov. 5, 2009

(65) Prior Publication Data

US 2011/0049226 A1 Mar. 3, 2011

(30) Foreign Application Priority Data

Apr. 4, 2008 (FR) ..... 08 01890

(51) Int. Cl.
*B65D 17/28* (2006.01)

(52) U.S. Cl.
USPC . 229/211; 206/736; 229/125.19; 229/125.32; 229/164; 229/235

(58) Field of Classification Search
USPC ..... 229/125.19, 164, 210, 211, 235, 229/125.32; 206/736, 774
See application file for complete search history.

(56) References Cited

U.S. PATENT DOCUMENTS 2,474,523 A * 6/1949 Guyer ..... 229/210
4,211,322 A * 7/1980 Crescenzi et al. ..... 229/164
(Continued)

FOREIGN PATENT DOCUMENTS

EP 0 592 939 A 4/1994
EP 0 637 548 A 2/1995
(Continued)

OTHER PUBLICATIONS

International Search Report for PCT/FR2009/000382 (WO/2009/133279), mailed Nov. 26, 2009.

*Primary Examiner* — Gary Elkins
(74) *Attorney, Agent, or Firm* — Banner & Witcoff, Ltd.

(57) ABSTRACT

The invention relates to a set of blanks for making a packaging box (1), to such a box and to a method for making such a box. The set includes a first blank comprising at least four main flaps connected together by first folding lines for forming the walls of the base (3) of the box, and a second blank including three panels connected together by third folding lines and including flips connected to the panels by a fourth folding line for forming the lid (2) of said box. A tearable flap (30) is connected to a flap by a perforated junction line (31), two flaps and two non-adjacent trapezoidal panels for forming the side walls and the base of the lid, wherein the two blanks are arranged so as to enable a sufficient covering in order to glue the same onto each other at the opposite inner and outer edges of the flaps and trapezoidal panels when the perforated folding line and the fourth folding lines are aligned or substantially aligned.

24 Claims, 5 Drawing Sheets

(56) References Cited

U.S. PATENT DOCUMENTS

| | | | | |
|---|---|---|---|---|
| 5,505,368 | A * | 4/1996 | Kanter et al. | 229/125.19 |
| 5,842,576 | A * | 12/1998 | Snow | 206/736 |
| 6,478,159 | B1 * | 11/2002 | Taylor et al. | 206/774 |
| 6,557,708 | B2 * | 5/2003 | Polacco | 206/774 |
| 2002/0043554 | A1 * | 4/2002 | White et al. | 229/235 |
| 2007/0221715 | A1 * | 9/2007 | Tibbels et al. | 229/125.19 |

FOREIGN PATENT DOCUMENTS

| | | | |
|---|---|---|---|
| FR | 2 899 566 | A | 10/2007 |
| GB | 2 319 241 | A | 5/1998 |
| WO | 01/95769 | A | 12/2001 |

* cited by examiner

SET OF CARDBOARD BLANKS, BOX AND METHOD FOR MAKING A BOX WITH SUCH BLANKS

The present invention relates to a set of blanks for a cardboard or corrugated cardboard box comprising a tear-off lid.

It also relates to a box obtained with such a set and a method for making such a box.

It finds a particularly important, but not exclusive, application in the field of packaging for rigid products (jars, boxes, etc.) or semi-rigid products (bags, etc.), making it possible to easily display the products in an immediate, clean and attractive manner, particularly on the shelves in the aisles of supermarket stores.

Packing boxes are already known (EP 0 637 548) allowing a rapid disconnection of the top portion of the box from the bottom portion forming a gondola, allowing a rapid display of the content of the packaging in said gondola.

Such a case, obtained from two different flongs bonded to one another however has the drawback of not making it possible to easily, rapidly and totally remove the lid of the package in order to display the products on a shelf vertically without risking causing them to slide.

Also known (U.S. Pat. No. 3,533,549) is a box formed by a flong with an opening at the top obtained by manually tearing off the lid, and a reinforced handle. Here again, such a rigid box does not make it possible to easily remove the lid to make the products accessible.

The object of the present invention is to provide a set of blanks, a box and a method for making a box providing a better response than those of the prior art to the requirements of the practice, notably in that it allows the rapid and effective removal of the lid of the packaging in one step, through a simple manual tearing movement. An impeccable display of the products in a gondola-shaped base is therefore obtained directly on the shelves in the stores, the packaging with the lid having been placed there previously.

Moreover, the invention allows automated manufacture at a high production rate (higher than twenty boxes/min), whether this is as boxes assembled and ready to be filled or as folded/bonded boxes, the boxes obtained being very robust and moreover being easily stackable on pallets.

It also makes it possible to ensure better than before a perfectly controlled, easy and 100% reliable installation while allowing an optimized strength of the zone to be torn in order to prevent any accidental risk of tearing of the attachment points, for example because of an impact on the weakened zone or of a violent movement of the products inside the packaging, the products being able, in an advantageous embodiment, to themselves play a supporting role authorizing an excellent resistance to compression because of this.

For this purpose, the present invention proposes notably a set of blanks for making a packaging box, comprising two blanks made of corrugated cardboard sheet material, namely a first blank comprising a first series of at least four main flaps terminated by a fastening tab, connected together by first fold lines parallel with one another and furnished on one side with a first series of folding elements connected to said first series of flaps by second fold lines perpendicular to said first fold lines, said first series of flaps being capable of forming the walls of the base of the box and a second blank comprising a second series of three panels connected together by third fold lines parallel with one another and furnished on the other side with a second series of folding elements connected to said second series of panels by fourth fold lines, said second blank being suitable for forming the lid of said box, characterized in that the first series of flaps comprises a first rectangular flap designed to form the back wall of the base, furnished on the other side of the first series of folding elements with a tear-off folding element connected to said flap by a perforated junction line, two nonadjacent trapezoidal flaps designed to form the side walls of the base comprising an inner edge directed at least partly slantwise toward a central flap of reduced height designed to form the front face wall of the base, and said central flap being of reduced height, in that the second series of three panels comprises one rectangular central panel and two trapezoidal side panels comprising an outer edge directed at least partly slantwise in the direction of the second series of folding elements, in directions parallel to the facing inner edges of the first trapezoidal flaps when the third fold lines of the second blank are inline or substantially inline with the first fold lines of the first blank, and in that the two blanks are arranged to allow a sufficient overlap to allow one to be bonded to the other at the facing inner and outer edges of the trapezoidal flaps and panels when the perforated fold line and the fourth fold lines are inline or substantially inline.

"Perforated junction line" means a junction line consisting of a few attachment points or attachment portions between the folding element and the adjacent flap, which makes the two elements easy to separate from one another, by tearing the junction line while combining a pull perpendicular to the line and a progressive detachment of the attachment points one after the other.

The precut junction line is therefore arranged to have good strength in the direction of the line and/or so long as a beginning of tearing has not been made.

Advantageously, a hard point makes it possible to prevent a beginning of tearing on either side of the line and/or in the middle.

Therefore, the precut portion and/or the precut line are arranged to have good strength in the vertical direction while the forces are exerted essentially in the plane of the walls. This strength is notably sufficient to allow the transport of the products even if the package is picked up by the top portion.

Conventionally, the precut line is obtained by perforating the cardboard like a dashed line with cutting blades called "perforating rules". The dashed lines are therefore defined by a regular alternation of perforated dashes called "cuts" and unperforated dashes called "attachment points".

In the present case, since the path followed by the dashed lines must also be used as a fold line, the rules also have a function called "scoring", that is to say that, between the perforations, the attachment points are squashed by deeper rules in order to make it easier subsequently to fold along the line concerned.

"Substantially inline" means inline (for example because of the chewing of the grooving of the fold line) or, in one embodiment, slightly offset from the facing fold line by a value corresponding at the minimum to the total value of the thicknesses of the papers forming the flongs, but nevertheless very little, that is to say by a value less than the order of 1 or 2 mm, or as specified below for example, of 0.5 to 0.7 mm between grooving.

The fold lines according to the embodiments of the invention more particularly described are, for their part, single lines, that is to say the grooving of which forms a ridge the crest of which is unilinear.

"Bonding" should be understood to be bonding that prevents relative movement, that is to say preventing movement in the direction of the plane of the flaps or panels, without tearing or separating.

Conversely, such a bonding may allow a subsequent separation of the elements of the box thus formed by the transverse tearing of one relative to the other in a manual fashion, in order to release the lid from the base forming a gondola.

In advantageous embodiments, use is also made of one and/or the other of the following arrangements:

- the portions of third fold lines facing the first fold lines are cut;
- the portions of third fold lines facing the first fold lines are squashed;
- the portions of third fold lines facing the first fold lines are hollowed out;
- with the bottom edge of the second blank opposite or substantially opposite the second fold lines, the cut, squashed or hollowed out portions extend upward for a length slightly greater than the height of the central flap of the first blank;
- the panels or the trapezoidal flaps comprise recesses close to the bonding points in order to make it easier to detach the trapezoidal walls from the trapezoidal flaps manually simply by pulling;
- the thickness of the cardboard of the base is different from that of the cardboard of the lid;
- the tear-off folding element or the facing portion of the corresponding flap comprises, close to the fourth perforated junction line, a recessed or cut portion forming a handle which a user can get hold of to tear off the lid;
- the first and the second blank originate from the same flong;
- the first blank has eight flaps, namely four main flaps separated from one another by intermediate flaps suitable for forming cut corners of the box.

The invention also proposes a packaging box with polygonal section, formed from two blanks of corrugated cardboard sheet material, namely a first blank comprising a series of at least four main flaps terminated by a fastening tab, connected together by first fold lines parallel with one another, said series of flaps forming the walls of the base of the box and being connected on one side to a series of folding elements by second fold lines perpendicular to said first fold lines, said series of folding elements forming the bottom of said box, and a second blank comprising a second series of three panels connected together by third parallel fold lines and furnished on the other side with a second series of folding elements connected to said second series of panels by fourth fold lines, said second blank forming the lid of said box, the panels of the second blank being partly superposed on the first blank, characterized in that the first series of flaps comprises a first rectangular flap designed to form the back wall of the base, furnished on the other side to the first series of folding elements with a tear-off folding element connected to said flap by a perforated junction line, two nonadjacent trapezoidal flaps designed to form the side walls of the base comprising an inner edge directed at least partly slantwise toward a central flap of reduced height designed to form the front face wall of the base, and said central flap being of reduced height,

- in that the second series of three panels comprises one rectangular central panel and two trapezoidal side panels comprising an outer edge directed at least partly slantwise in the direction of the second series of folding elements, in directions parallel to the facing inner edges of the first trapezoidal flaps when the third fold lines of the second blank are inline or substantially inline with the first fold lines of the first blank, and in that the two blanks are bonded to one another at the facing inner and outer edges of the trapezoidal flaps and panels when the perforated fold line and the fourth fold lines are inline or substantially inline.

Advantageously, the first blank is attached to the outside of the second blank.

Also advantageously, the first blank is attached to the inside of the second blank.

In advantageous embodiments use is also made of one and/or the other of the following arrangements:

- the box is formed by rolling said blanks around a volume of determined dimensions, and the third fold lines of the second blank are substantially inline with the first fold lines of the first blank, said third fold lines comprising in the bottom part a cut, squashed or hollowed-out portion facing the corresponding first fold line;
- the box is formed by rolling said blanks around a volume of determined dimensions, the third fold lines of the second blank being inline with the first fold lines of the facing first blank and the panels being bonded and the bondings being arranged to allow the panels to slide over the corresponding flaps;
- the box is formed by rolling said blanks around a volume of determined dimensions, the portion or portions of the third fold lines facing the first fold lines being squashed or cut;
- when the box is formed folded/joined, the portion or portions of third fold lines facing the first fold lines are hollowed out;
- the thickness of the cardboard of the base is different from that of the cardboard of the lid;
- the cut, hollowed out or squashed portions extend upward for a length slightly greater than the height of the central flap of the first blank.

The invention also proposes a method for making a box as described above, in which the two blanks are cut from one and the same flong, the two blanks are offset relative to one another in order to be partially superposed and they are bonded to one another at the facing inner and outer edges of the trapezoidal flaps and panels when the perforated fold line and the fourth fold lines are inline or substantially inline.

Advantageously, the tab of the first blank is folded and bonded onto the second blank.

Equally advantageously, the set of blanks secured by bonding is wrapped around a core.

The invention will be better understood on reading the following description of the embodiments given below as nonlimiting examples.

It refers to the drawings accompanying it in which.

Figures 1A, 1B, 1C:
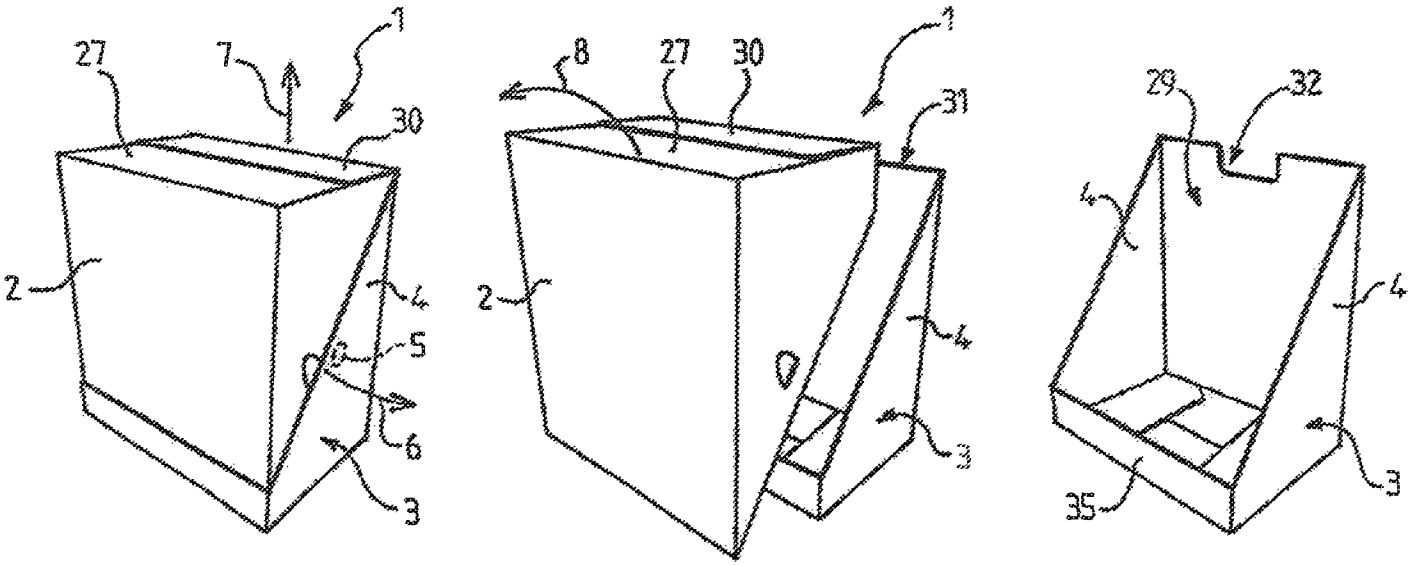
FIGS. 1A, 1B and 1C show in perspective the box according to one embodiment of the invention before, during and after opening.

FIGS. 1A to 1C show a packaging box 1 of parallelepipedal shape comprising a lid 2 and a base 3 for displaying products (not shown).

The lid 2 is attached by bonding to the slantwise walls 4 of the base 3 with dots of glue 5, the lid being separated from the base by lateral pulling 6 and vertical tearing (arrow 7) as indicated in FIG. 1A.

The lid 2 is then removed by pulling it forward (arrow 8) in order to leave the display base or gondola 3 as shown in FIG. 1C.

Figure 2:
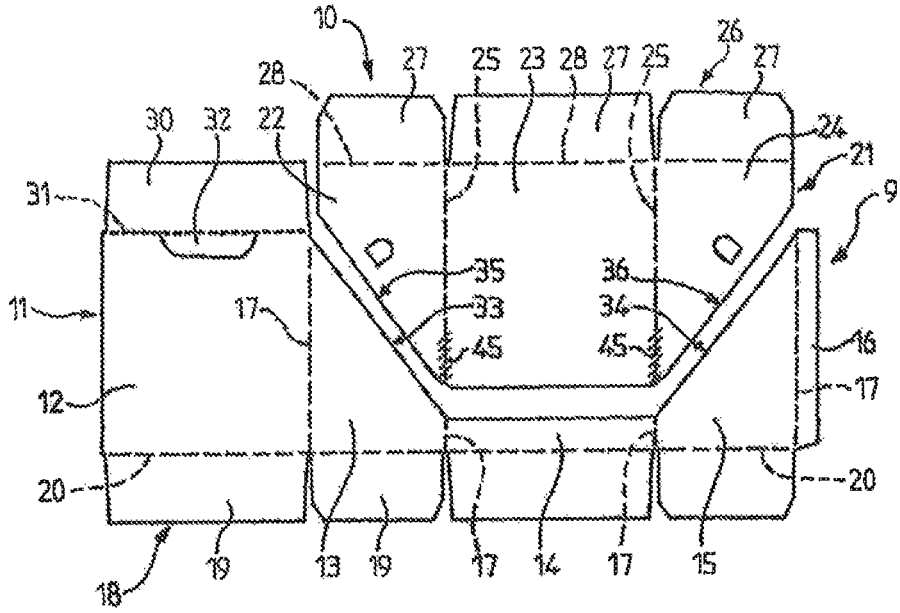
FIGS. 2 and 3 are plan views of a set of blanks according to a first embodiment of the invention, before and after being put together.
Figure 3:
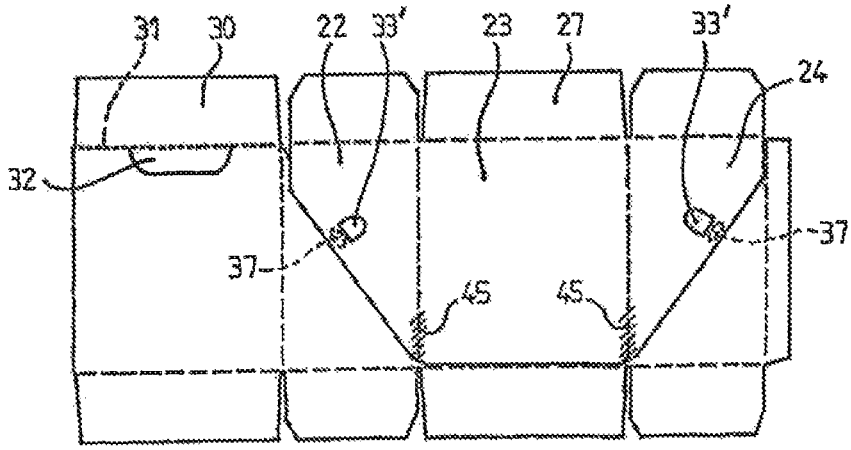

With reference to FIGS. 2 and 3, the base 3 is obtained from a first blank 9 with four flaps, the lid 2 for its part being obtained from a second blank 10 with three panels, both blanks being for example cut out from one and the same flong.

More precisely, the first blank 9 comprises a first series 11 of four flaps 12, 13, 14 and 15 terminated by a fastening tab 16 and connected together by first fold lines 17 parallel with one another.

This first series is furnished on one side with a first series 18 of folding elements 19 connected to said first series of flaps by second fold lines 20 perpendicular to said first fold lines.

The second blank 10 intended to form the lid of the box 1 comprises a second series 21 of three panels 22, 23 and 24 connected together by third fold lines 25 parallel with one another and furnished on the other side with a second series 26 of folding elements 27 connected to the second series of panels by fourth fold lines 28.

The folding elements of the first series 18 and of the second series 26 are for example rectangular or substantially rectangular with sides slightly slanting in order to make it easier to form the bottom and the top of the box by folding, without risking catching the edges.

According to the embodiment of the invention more particularly described, the first series 11 of flaps comprises a first rectangular flap 12 designed to form the back wall 29 (see FIG. 1C) of the base.

It is furnished, on the other side to the first series 18 of folding elements, with a tear-off folding element 30 connected to the flap 12 by a perforated junction line 31.

A portion 32 in the shape of a handle, cut in the portion of the flap 12, is provided to facilitate manual tearing by a user in the direction of the arrow 8 of FIG. 1B.

The first series of flaps 18 also comprises two flaps 13 and 15, which are symmetrical relative to a straight line, nonadjacent and trapezoidal, and are designed to form the side walls 4 of the base and each comprising an inner edge 33, 34, respectively, directed at least partly slantwise toward the central flap 14, which is of reduced height and is intended to form the wall 35 (see FIG. 1C) of the front face of the base 3.

"Reduced height" should be understood to mean a wall of lesser height than that of the back wall, for example 5 to 10 times less.

The second series of panels 21 comprises, for its part, the two trapezoidal end panels 22 and 24 with slanting outer edges 35, 36 of a shape to match that of the inner edges 33, 34 of the first blank, and the rectangular central panel 23, for example of the same height as the flap 12.

In the rest of the description, the same reference numbers are used to designate the same elements or similar elements.

FIG. 3 shows the assembly of two blanks bonded to one another, with a sufficient overlap to allow bonding at the bonding points 37 on the facing inner and outer edges of the trapezoidal flaps and panels, when the perforated fold line 31 and the fourth fold lines 28 are inline or substantially inline as shown in the figures.

"Substantially inline" means an arrangement which allows a better closure of the top folding elements by lapping them over one another, so as to form the top of the boxes as shown in FIGS. 1A to 1C or 4 and 5.

Specifically, in order to form the top of the box once it has been filled, the small folding elements 27 corresponding to the two trapezoidal flaps 22 and 24 are folded and then the two large folding elements 27 and 30, corresponding on the one hand to the central panel 23 of the second blank and on the other hand to the bottom flap 12 of the first blank, are bonded on top, in order to finish the lid that can be torn off (see notably FIG. 4 and FIG. 1C) by the user by inserting his hand and/or his fingers through the recessed portion 32.

Small orifices 33' centered in the walls 22 and 23 for their part make it easier to detach the side walls of the lid and base.

Figure 4:
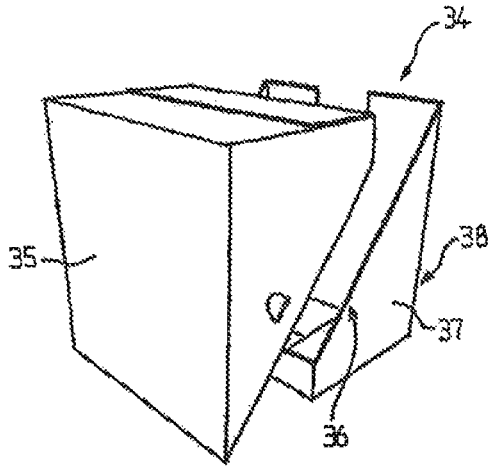
FIGS. 4 and 5 show another embodiment of the box according to the invention after and before opening.
Figure 5:
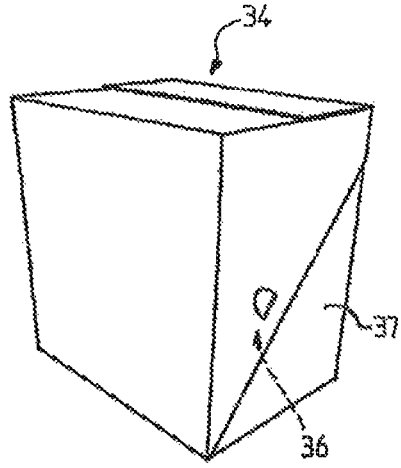

FIGS. 4 and 5 show another embodiment of a box 34 according to the invention in which, this time, the lid 35 is bonded to the outside 36 of the trapezoidal slantwise walls 37 of the base 38 and not to the inside as shown in FIG. 1A.

Figure 6:
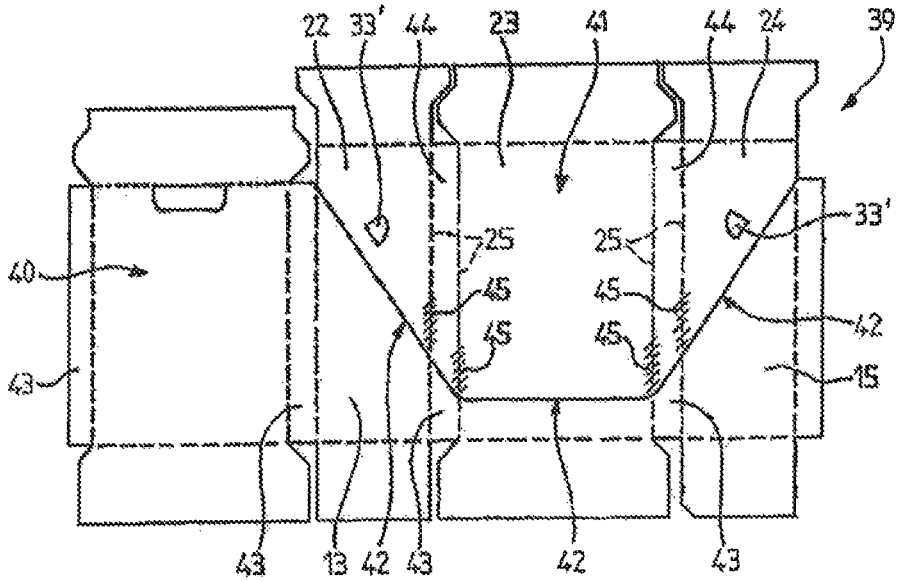
FIG. 6 is a plan view of another embodiment of a set of blanks according to the invention for an eight-sided box.

FIG. 6 shows another embodiment of a flong 39 with eight sides according to the invention.

In this embodiment, the set of blanks 40, 41 is obtained from the same flong 39 cut along the line 42 to obtain the slantwise outer edges of the trapezoidal flaps and panels of the two blanks according to the invention, the second blank then being offset in order to allow the bonding.

Intermediate flaps and panels 43, 44 are furthermore provided to form the cut corners of the eight-sided flong.

Here again and advantageously, each of the trapezoidal panels 22, 24 comprises recesses 33 close to the bonding points in order to make it easier to detach the trapezoidal walls from the trapezoidal flaps manually simply by pulling, for example, as shown in FIG. 1A.

In the embodiments described above, the lower portions 45 of the third fold lines 25 opposite the first fold lines 17 of the small flap 14 are either cut or squashed in order to allow, during the wrapping of the bonded assembly around a core, a certain flexibility that is notably sufficient to prevent the bonding points being torn apart.

Figure 7:
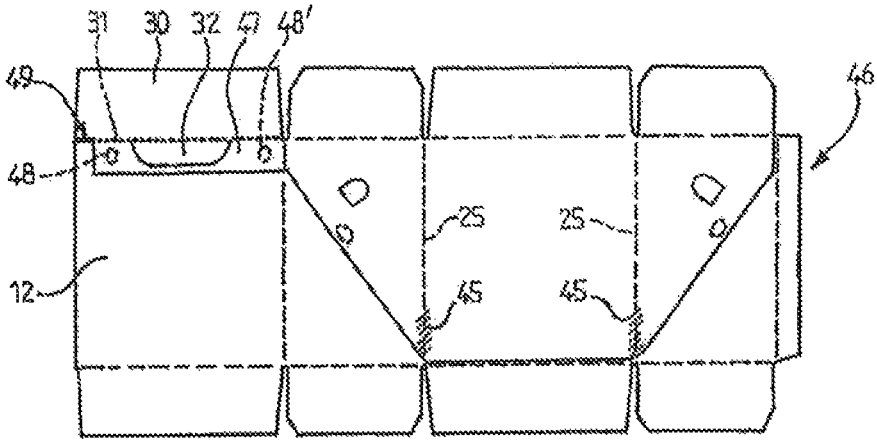
FIG. 7 is a plan view of another embodiment of a set according to the invention.

FIG. 7 represents another embodiment of a set 46 in which the folding element 30 connected by a perforated line 31 is not secured to the flap 12 forming the back of the base but belongs to the second blank 10 furnished with a fourth panel 47 comprising said folding element on its upper portion, which involves providing additional bonding points 48 when the line 31 is aligned with the facing upper line 49 of said flap which forms the back of the base.

Figure 8:
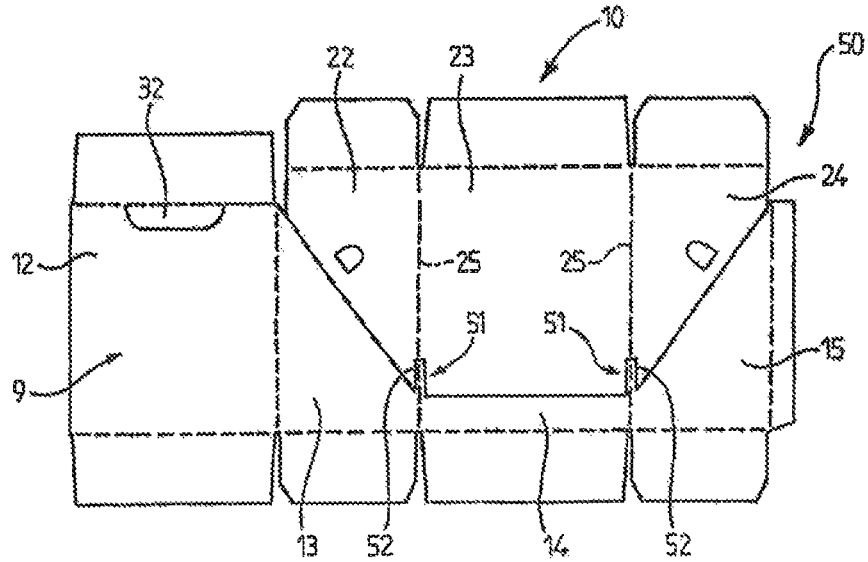
FIGS. 8, 9 and 10 are plan views of another embodiment of a set of blanks according to the invention before bonding, after bonding and after folding.
Figure 9:
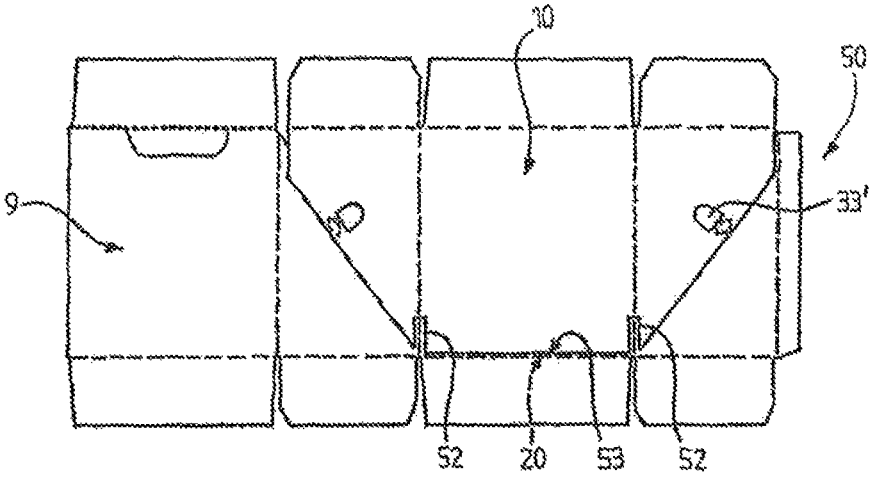
Figure 10:
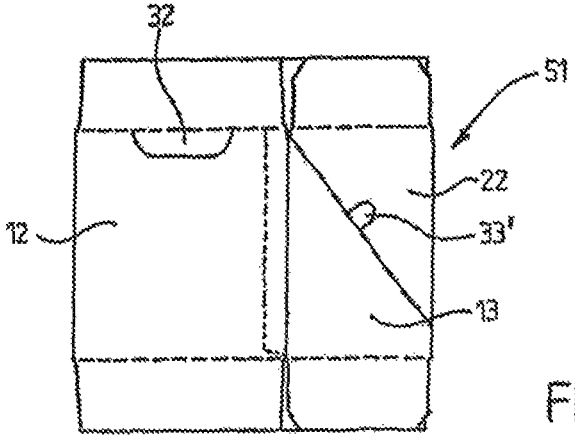

FIGS. 8 to 10 show another embodiment of a set 50 according to the invention this time allowing not a formation of the box by wrapping around a core as more particularly described with reference to the preceding figures, but a folded bonded packaging 51.

More precisely, FIG. 8 shows a set of two blanks 9, 10 comprising a first blank 9 with four flaps 12, 13, 14, 15 and a second blank 10 with three panels 22, 23, 24, the lower portion 51 of the third fold lines 25 this time not being folded, squashed or cut but hollowed out, for example in the form of a small rectangular recess 52 which will compensate for any clearances during folding/bonding.

FIG. 9 shows the second blank 10 superposed on the first blank 9, the lower edge 53 of the panel 23 being substantially superposed on the fold line 20 as also described above with reference to the preceding figures.

These recesses or notches 52, necessary for making up for the extra thicknesses, are notably a first notch 52 provided for the 90° folding of a first line of the third fold lines (when the box is reopened) and a second notch, this one being bigger, necessary for making up for the extra thicknesses during the 180° folding of the third fold line, before the case is delivered flat as shown at 51 in FIG. 10.

The latter can then be opened like an "American case" on a conventional box opener, or else manually.

With respect to FIG. 6, which will therefore make it possible to obtain an eight-sided packaging box, it will be noted that an offset is provided between the fold line of the first blank corresponding to the first small side and that of the base of the corresponding lid, for example of x mm just enough to compensate for what happens during superposition.

Here the insert can be situated inside the box or on the outside as an option, the latter case involving different offsets.

With reference to FIGS. 8 to 10, the manufacture, operation and use will now be described according to one embodiment of the invention.

From a flong 50, the two blanks 9 and 10 are cut and are separated from one another and then they are superposed while separating them after having applied the spots of glue 37 on one and/or two portions close to the orifices 33 so as to subsequently allow the lid to be separated easily from the base.

The assembly thus formed is then joined with the bonding paste or tab 16, by folding two vertical fold lines through 180°.

Once at the packagers' premises, the set of two blanks can be opened manually or automatically in the same sequence as for an "American case".

The upper and lower folding elements are, for their part, folded through 90° and then bonded or taped to one another.

When the box thus obtained is placed in the aisle where it is to be displayed, the three front panels are removed in the following sequence.

After the box has been placed on the shelf, and with reference to FIG. 1A, the walls are separated at the lateral openings in order to tear apart the bonding points 5.

The attachment points of the perforated line 31 of the upper folding element 30 next to the base are then torn (FIG. 1B), by manually taking hold of the cutaway handle 32. The lid 2 is then torn off with a lateral movement (arrow 8) and the three panels of what formed an insert are then completely taken away in order to completely free the base 3 and achieve a clear, ordered display of the products directly on the shelf.

This prevents the movements of a base holding products which may slide or shift during such a transportation.

Specifically, the base is placed directly in the aisle and the removal of the lid takes place only when the assembly is no longer likely to move.

In another embodiment, in which the two blanks are wrapped around a core after bonding, the following operations are carried out.

The third fold lines 25 in the bottom portion 45 are cut and/or squashed in the portions designed to be placed opposite the corresponding first fold lines.

The two trapezoidal flaps that are opposite and not adjacent are then pasted.

The second blank is then placed on the first blank, the three cut or squashed fold lines of the second blank being substantially inline with the first fold line of the first blank.

What follows is a superposition of the cut or squashed zones of the third fold lines with the first fold lines over their whole height and, in one embodiment, over a slightly greater height, so that the zones extend above the edge with no folding element of the first blank.

The second blank is then pressed onto the first blank to secure together the two panels and the two nonadjacent flaps so that any translational movement in the direction of the plane of the flongs is made impossible without destruction, that is to say without tearing-off and/or separation of one of the two cardboards.

This set of blanks is then positioned under a core, in this instance under an unpasted face and the set of blanks is folded by rolling around the determined volume of the core, without the second blank sliding relative to the first blank, except in the region of the last panels.

The fact that the portions of the third fold lines have been cut or squashed according to the embodiment of the invention described above then allows formation without folding, squashing or tearing of the flaps and panels of the box.

But another embodiment is also possible during wrapping around a core in the case in which, on this occasion, sliding is permitted in the region of the (viscous) bonding points, in which case the compensation will be effected by virtue of such sliding.

It goes without saying and also results from the foregoing that the present invention is not limited to the embodiments more particularly described. In contrast, it covers all the variants and notably those in which the cardboard of the first and second blanks differs in strength.

The invention claimed is:

1. A set of blanks for making a packaging box, comprising two blanks made of a corrugated cardboard sheet material, namely:

a first blank comprising a first series of at least four main flaps terminated by a fastening tab, connected together by first fold lines parallel with one another and, having on a first side, a first series of folding elements connected to said first series of at least four main flaps by second fold lines perpendicular to said first fold lines, said first series of at least four main flaps being adapted to form walls of a base of the packaging box, and a second blank comprising a second series of at least three panels connected together by third fold lines parallel with one another and having a second series of folding elements connected to said second series of at least three panels by fourth fold lines, said second blank being suitable for forming a lid of said box, wherein:

the at least four main flaps of the first series of at least four main flaps respectively comprise:

a first rectangular flap designed to form a back wall of the base, having on a second side the first series of folding elements with a tear-off folding element connected to said first rectangular flap by a perforated junction line, and two nonadjacent trapezoidal flaps designed to form side walls of the base, each comprising an inner edge directed at least partly slantwise toward a central flap of reduced height as compared to said two nonadjacent trapezoidal flaps and designed to form a front face wall of the base, the at least three panels of the second series of at least three panels respectively comprise one rectangular central panel and two trapezoidal side panels comprising an outer edge directed at least partly slantwise in the direction of the second series of folding elements and in directions parallel to facing inner edges of the two nonadjacent trapezoidal flaps when the third fold lines of the second blank are in line or substantially in line with the first fold lines of the first blank, and the two blanks are arranged to allow a sufficient overlap to allow one to be bonded to the other at facing inner and outer edges of trapezoidal flaps and panels when the perforated junction line and the fourth fold lines are in line or substantially in line.

2. The set of blanks as claimed in claim 1, characterized in that portions of the third fold lines facing the first fold lines are cut.

3. The set of blanks as claimed in claim 1, characterized in that portions of the third fold lines facing the first fold lines are squashed.

4. The set of blanks as claimed in claim 1, characterized in that the third fold lines facing the first fold lines are hollowed out.

5. The set of blanks as claimed in claim 1, characterized in that, a bottom edge of the second blank is opposite or substantially opposite the second fold lines, and at least one of a cut, squashed and hollowed-out portion of the third fold lines extends upward for a length slightly greater than a height of the central flap.

6. The set of blanks as claimed in claim 1, characterized in that at least one of said trapezoidal flaps and panels comprises recesses close to bonding points in order to make it easier to detach trapezoidal walls from trapezoidal flaps of said trapezoidal flaps and panels manually by pulling.

7. The set of blanks as claimed in claim 1, characterized in that a thickness of the base is different from a thickness of the lid.

8. The set of blanks as claimed in claim 1, characterized in that at least one of the tear-off folding element and a facing portion of one of said flaps comprises, close to the perforated junction line, at least one of a recessed and a cut portion forming a handle which a user can get hold of to tear off the lid.

9. The set of blanks as claimed in claim 1, characterized in that the first blank and the second blank originate from a same flong.

10. The set of blanks as claimed in claim 1, characterized in that the first blank has eight flaps, namely said at least four main flaps separated from one another by intermediate flaps suitable for forming cut corners of the box.

11. A packaging box of a polygonal section, formed from two blanks of a sheet material, namely:

a first blank comprising a series of at least four main flaps terminated by a fastening tab, connected together by first fold lines parallel with one another, said series of at least four main flaps forming walls of a base of the packaging box and being connected on a first side to a first series of folding elements by second fold lines perpendicular to said first fold lines, said first series of folding elements forming a bottom of said packaging box, and a second blank comprising a series of at least three panels connected together by third fold lines parallel with one another and having on a second side a second series of folding elements connected to said series of at least three panels by fourth fold lines, said second blank forming a lid of said packaging box, the series of at least three panels being partly superposed on the first blank, characterized in that:

the at least four main flaps of the series of at least four main flaps respectively comprise:

a first rectangular flap designed to form a back wall of the base, having on a side of the first series of folding elements a tear-off folding element connected to said first rectangular flap by a perforated junction line, and two nonadjacent trapezoidal flaps designed to form side walls of the base, each comprising an inner edge directed at least partly slantwise toward a central flap of a reduced height compared to said two nonadjacent trapezoidal flaps and designed to form a front face wall of the base, the at least three panels of the series of at least three panels respectively comprise one rectangular central panel and two trapezoidal side panels comprising an outer edge directed at least partly slantwise in the direction of the second series of folding elements, respectively in directions parallel to facing inner edges of the two nonadjacent trapezoidal flaps when the third fold lines of the second blank are in line or substantially in line with the first fold lines of the first blank, and the two blanks are bonded to one another at facing inner and outer edges of trapezoidal flaps and panels when the perforated junction line and the fourth fold lines are in line or substantially in line.

12. The packaging box as claimed in claim 11, characterized in that the first blank is attached to an outer side of the second blank.

13. The packaging box as claimed in claim 12, characterized in that the first blank is attached to an inner side of the second blank.

14. The packaging box as claimed in claim 11, characterized in that it is formed by rolling said blanks around a volume of determined dimensions, the third fold lines of the second blank are substantially in line with the first fold lines of the first blank, said third fold lines comprising, in a bottom part, at least one of a cut, a squashed and a hollowed-out portion facing one of the first fold lines.

15. The packaging box as claimed in claim 14, characterized in that it is formed by rolling said blanks around a volume of determined dimensions, the third fold lines of the second blank being in line with the first fold lines of the first blank and panels being bonded by one or more bondings arranged to allow said panels to slide over corresponding flaps.

16. The packaging box as claimed in claim 14, characterized in that it is formed by rolling said first and second blanks around a volume of determined dimensions, the third fold lines facing the first fold lines having at least one of a squashed portion and a cut portion.

17. The packaging box as claimed in claim 15, characterized in that portions of the third fold lines facing the first fold lines are hollowed-out.

18. The packaging box as claimed in claim 11, characterized in that a thickness of cardboard of the base is different from a thickness of cardboard of the lid.

19. The packaging box as claimed in claim 11, characterized in that at least one of a cut, hollowed-out and squashed portion of the third fold lines extends upward for a length slightly greater than a height of the central flap.

20. The packaging box as claimed in claim 11, characterized in that the first blank has eight flaps, namely said at least four main flaps separated from one another by intermediate flaps suitable for forming cut corners of the packaging box.

21. The packaging box as claimed in claim 11, characterized in that the two blanks are cut from one and the same flong, the two blanks are offset relative to one another in order to be partially superposed and the two blanks are bonded to one another at the facing inner and outer edges of said trapezoidal flaps and panels when the perforated junction line and the fourth fold lines are in line or substantially in line.

22. The packaging box as claimed in claim 21, characterized in that the fastening tab of the first blank is folded and bonded onto the second blank.

23. The packaging box as claimed in claim 21, characterized in that the two blanks, which are secured by bonding, are wrapped around a core.

24. A method, comprising:

forming, from two blanks of a sheet material, a packaging box of a polygonal section, said forming comprising:

forming walls of a base of the packaging box with a series of at least four main flaps of a first blank of said two blanks, said series of at least four main flaps being connected together by first fold lines parallel with one another, and terminated by a fastening tab, wherein forming walls of the base comprises forming a back wall of the base with a first rectangular flap of the series of at least four main flaps, said first rectangular flap connected to, by a perforated junction line, a tear-off folding element that is on a side of the first series of folding elements, wherein forming walls of the base further comprises forming side walls of the base with two nonadjacent trapezoidal flaps of the series of at least four main flaps, each of said two nonadjacent trapezoidal flaps comprising an inner edge directed at least partly slantwise toward a central flap of a reduced height compared to said two nonadjacent trapezoidal flaps, wherein forming walls of the base further comprises forming a front wall of the base with the central flap, forming a bottom of said packaging box with a first series of folding elements, said first series of folding elements being connected to said series of at least four main flaps on a first side by second fold lines perpendicular to said first fold lines, forming a lid of said packaging box with a second blank of said two blanks, the second blank comprising a series of at least three panels connected together by third fold lines parallel with one another and having on a second side a second series of folding elements connected to said series of at least three panels by fourth fold lines, wherein the series of at least three panels comprises one rectangular central panel and two nonadjacent trapezoidal side panels comprising an outer edge directed at least partly slantwise in the direction of the second series of folding elements, respectively in directions parallel to facing inner edges of the two nonadjacent trapezoidal flaps when the third fold lines of the second blank are in line or substantially in line with the first fold lines of the first blank at least partly superimposing the series of at least three panels on the first blank, and bonding the two blanks to one another at facing inner and outer edges of trapezoidal flaps and panels when the perforated fold line and the fourth fold lines are in line or substantially in line.

* * * * *

UNITED STATES PATENT AND TRADEMARK OFFICE

CERTIFICATE OF CORRECTION

PATENT NO. : 8,590,773 B2
APPLICATION NO. : 12/936060
DATED : November 26, 2013
INVENTOR(S) : Moreau et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 494 days.

Signed and Sealed this
Twenty-second Day of September, 2015

Michelle K. Lee

Michelle K. Lee
*Director of the United States Patent and Trademark Office*